United States Patent [19]

O'Handley et al.

[11] 4,038,073

[45] July 26, 1977

[54] NEAR-ZERO MAGNETOSTRICTIVE GLASSY METAL ALLOYS WITH HIGH SATURATION INDUCTION

[75] Inventors: Robert Charles O'Handley, Morris Plains; Ethan Allen Nesbitt, Beach Haven; Lewis Isaac Mendelsohn, Morristown, all of N.J.

[73] Assignee: Allied Chemical Corporation, Morris Township, N.J.

[21] Appl. No.: 662,639

[22] Filed: Mar. 1, 1976

[51] Int. Cl.[2] ..... C22C 19/07

[52] U.S. Cl. ..... 75/170; 148/31.55

[58] Field of Search ..... 75/170, 134 F, 122; 148/31.55

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |

*Primary Examiner*—Arthur J. Steiner

*Attorney, Agent, or Firm*—David W. Collins; Ernest A. Polin

[57] ABSTRACT

A new series of glassy metal alloys with near-zero magnetostriction is disclosed. The glassy alloys have the composition $(Co_xFe_{1-x})_aB_bC_c$, where $x$ ranges from about 0.84 to 1.0, $a$ ranges from about 78 to 85 atom percent, $b$ ranges from about 10 to 22 atom percent and $c$ ranges from 0 to 12 atom percent, with the proviso that the sum of $b$ and $c$ ranges from about 15 to 22 atom percent. The magnetostriction of these alloys ranges from about $+5 \times 10^{-6}$ to $-5 \times 10^{-6}$ and the saturation induction is at least about 10 kGauss. The transition metal content is responsible for the low magnetostriction in these alloys, as well as their high saturation induction. The metalloid content (needed to stabilize the glassy state which is one of low anisotropy) strongly affects the saturation induction and Curie temperature, but not the magnetostriction.

5 Claims, 2 Drawing Figures

NEAR-ZERO MAGNETOSTRICTIVE GLASSY METAL ALLOYS WITH HIGH SATURATION INDUCTION

BACKGROUND OF THE INVENTION

1. Field of the Invention

This invention relates to glassy metal alloys with near-zero magnetostriction and high saturation induction.

2. Desecription of the Prior Art

Saturation magnetostriction $\lambda_s$ is related to the fractional change in length $\Delta l/l$ that occurs in a magnetic material on going from the demagnetized to the saturated, ferromagnetic state. The value of magnetostriction, a dimensionless quantity, is often given in units of microstrains (i.e., a microstrain is a fractional change in length of one part per million).

Ferromagnetic alloys of low magnetostriction are desirable for several interrelated reasons:

1. Soft magnetic properties (low coercivity, high permeability) are generally obtained when both the saturation magnetostriction $\lambda_s$ and the magnetocrystalline anisotropy K approach zero. Therefore, given the same anisotropy, alloys of lower magnetostriction will show lower dc coercivities and higher permeabilities. Such alloys are suitable for magnetostatic shields or various other low frequency magnetic applications.

2. Magnetic properties of such zero magnetostrictive materials are insensitive to mechanical strains, provided the material is in the glass state. When this is the case, there is no need for stress-relief annealing after winding, punching or other physical handling needed to form a device from such material. In contrast, magnetic properties of stress-sensitive materials, such as the crystalline alloys, are seriously degraded by such cold working and must be carefully annealed.

3. The low dc coercivity of zero magnetostrictive materials carries over to ac operating conditions where again low coercivity and high permeability are realized (provided the magnetocrystalline anisotropy is not too large and the resistivity not too small). Also because energy is not lost to mechanical vibrations when the saturation magnetostriction is zero, the core loss of zero magnetostrictive materials can be quite low. Thus, zero magnetostrictive magnetic alloys (of moderate or low magnetocrystalline anisotropy) are useful where low loss and high ac permeability are required. Such applications include a variety of tape-wound and laminated core devices, such as power transformers and signal transformers.

4. Finally, electomagnetic devices containing zero magnetostrictive materials generated no acoustic noise under ac excitation. While this is the reason for the lower core loss mentioned above, it is also a desirable characteristic in itself because it eliminates the hum inherent in many electromagnetic devices.

There are three well-known crystalline alloys of zero magnetostriction (in atom percent, unless otherwise indicated):

1. Nickel-iron alloys containing approximately 80% nickel ("80 nickel permalloys");

2. Cobalt-iron alloys containing approximately 90% cobalt; and

3. Iron-silicon alloys containing approximately 6wt.% silicon.

Also included in these categories are zero magnetostrictive alloys based on the binaries but with small additions of other elements such as molybdenum, copper or aluminum to provide specific property changes. These include, for example 4% Mo, 79% Ni, 17% Fe (sold under the designation Moly Permalloy) for increased resistivity and permeability; permalloy plus varying amounts of copper (sold under the designation Mumetal) for magnetic softness and improved ductility; and 85 wt.% Fe, 9 wt.% Si, 6 wt.% Al (sold under the designation Sendust) for zero anisotropy.

The alloys included in (1) are the most widely used of the three classes listed above because they combine zero magnetostriction with low anisotropy and are, therefore, extremely soft magnetically; that is they have a low coercivity, a high permeability and a low core loss. These permalloys are also relatively soft mechanically so that they are easily rolled into sheet form, cut into tape form, and stamped into laminations. However, these materials have saturation inductions ($B_s$) ranging only from about 6 to 8 KGauss, which is a drawback in many applications. For example, if a given voltage V is required at the secondary of a signal transformer or a power transformer, then Farady's law, $V \propto -NA\Delta Bf$, shows that for a fixed frequency $f$ and number of secondary turns N, the cross-sectional area A of core material may be reduced if a larger change in flux density $\Delta B$ can be had by using a material of greater $B_s$. The use of less core material obviously reduces the size, weight and cost of the device as well as reducing both the amount of wire needed to obtain N winding turns and the loss in that wire.

2. Alloys based on $Co_{90}Fe_{10}$ have a much higher saturation induction ($B_s$ about 19 kGauss) than the permalloys. However, they also have a strong negative magnetocrystalline anisotropy, which prevents them from being good soft magnetic materials. For example, the initial permeability of $Co_{90}Fe_{10}$ is only about 100 to 200.

3. Fe/6 wt% Si and the related ternary alloy Sendust (mentioned above) also show higher saturation inductions ($B_s$ about 18 kGauss and 11 kGauss, respectively) than the permalloys. However, these alloys are exteremely brittle and have, therefore, found limited use in powder form only.

Clearly desirable is a zero magnetostrictive alloy of higher saturation induction than the permalloys but retaining low magnetic anisotropy and good ductility.

It is known that magnetocrystalline anisotropy is effectively eliminated in the glassy state. It is, therefore, desirable to seek glassy metal alloys of zero magnetostriction. Such alloys might be found near the compositions listed above. Because of the presence of metalloids which tend to quench the magnetization by the transfer of charge to the transition-metal d-electron states, however, glassy metal alloys based on the 80 nickel permalloys are either non-magnetic at room temperature or have unacceptably low saturation inductions. For example, the glassy alloy $Fe_{40}Ni_{40}P_{14}B_6$ (the subscripts are in atom percent) has a saturation induction of about 8 kGauss, while the glassy alloy $Ni_{49}Fe_{29}P_{14}B_6Si_2$ has a saturation induction of about 4.6 kGauss and the glass alloy $Ni_{80}P_{20}$ is non-magnetic. No glassy metal alloys having a saturation magnetostriction approximately equal to zero have yet been found near the iron-rich Sendust composition. Two zero magnetostrictive glassy metal alloys based on the Co-Fe crystalline alloy mentioned above in (2) have been reported in the literature. These are $Co_{72}Fe_3P_{16}B_6Al_3$ (*AIP Conference Proceedings*, No. 24 pp. 745–746 (1975)) and $Co_{71}Fe_4Si_{15}B_{10}$ (Vol. 14, *Japanese Journal of Applied Physics*, pp 1077–1078

(1975)). Table I lists some of the magnetic properties of these materials.

TABLE I

| | $Co_{72}Fe_3P_{16}B_6Al_3$ | $Co_{71}Fe_4Si_{15}B_{10}$ |
|---|---|---|
| $B_s$ (kGauss) | 6.0 | 6.4 |
| $H_c$ (as quenched)($O_e$) | 0.023 | 0.01 |
| $B_r$ (as quenched)(kGauss) | 2.84 | 2.24 |
| $H_c$ (field annealed)($O_e$) | 0.013* | 0.015** |
| $B_r$ (field annealed)(kGauss) | 4.5* | 5.25** |
| $T_C$(° K) | 650° | 688° |

*field annealed at 270° C for 45 min in 30 Oe applied longitudinally.
**field annealed at 350° C and cooled at 175° C/hr in 400 Oe applied longitudinally.

These glassy alloys show low coercivities and are expected to have high permeabilities and low core loss, because the saturation magnetostriction approximately is zero and, generally, in a glassy state the magnetocrystalline anisotropy is very small and the resistivity is high. However, their saturation inductions are at the lower limit of the range spanned by various high-nickel crystalline alloys. Thus, they offer little improvement over the properties of the crystalline permalloys.

SUMMARY OF THE INVENTION

In accordance with the invention, a magnetic alloy that is at least 50% glassy is provided having a near-zero magnetostriction and a high saturation induction. The glassy metal alloy has the composition $(Co_xFe_{1-x})_aB_bC_c$, where $x$ ranges from about 0.84 to 1.0, $a$ ranges from about 78 to 85 atom percent, $b$ ranges from about 10 to 22 atom percent, and $c$ ranges from 0 to about 12 atom percent, with the proviso that the sum of $b$ and c ranges from about 15 to 22 atom percent. The glassy alloy has a value of magnetostriction ranging from about $+5 \times 10^{-6}$ to $-5 \times 10^{-6}$ and a saturation induction of at least about 10 kGauss.

DETAILED DESCRIPTION OF THE INVENTION

In accordance with the invention, a magnetic alloy that is at least 50% glassy is provided having a near-zero magnetostriction and a high saturation induction. The glassy metal alloy has the composition $(Co_xFe_{1-x})_aB_bC_c$, where $x$ ranges from about 0.84 to 1.0, $a$ ranges from about 78 to 85 atom percent, $b$ ranges from about 10 to 22 atom percent, and $c$ ranges from 0 to about 12 atom percent, with the proviso that the sum of $b$ and $c$ ranges from about 15 to 22 atom percent. The glassy alloy has a value of magnetostriction ranging from about $+5 \times 10^{-6}$ to $-5 \times 10^{-6}$ and a saturation induction of at least about 10 kGauss.

The purity of the above composition is that found in normal commercial practice. However, it will be appreciated that the alloys of the invention may contain, based on total composition, up to about 4 atom percent of at least one other transition metal element, such as titanium, tungsten, molybdenum, chromium, manganese, nickel and copper and up to about 6 atom percent of at least one other metalloid element, such as silicon, aluminum and phosphorus, without significantly degrading the desirable magnetic properties of these glassy alloys.

Examples of essentially zero magnetostrictive glassy metal alloys of the invention include $Co_{74}Fe_6B_{20}$, $Co_{74}Fe_6B_{14}C_6$ and $Co_{74}Fe_6B_{16}C_4$. These glassy alloys possess low magnetic anisotropy because of their glassy structure, yet still retain a high saturation induction of about 11.8 kGauss and excellent ductility. Some magnetic properties are listed in Table II. These may be compared with properties listed in Table I for previously-reported glassy metal alloys of zero magnetostriction.

TABLE II

| | $Co_{74}Fe_6B_{20}$ | $Co_{74}Fe_6B_{14}C_6$ | $Co_{74}Fe_6B_{16}C_4$ |
|---|---|---|---|
| $B_s$ (kGauss) | 11.8 | 11.8 | 11.8 |
| $H_c$ (as quenched (Oe) | 0.03 | 0.04 | 0.03 |
| $B_r$ (as quenched) (kGauss) | 9.8 | | |
| $T_C$(° K) | 760°-810° | | |

Figure 1:
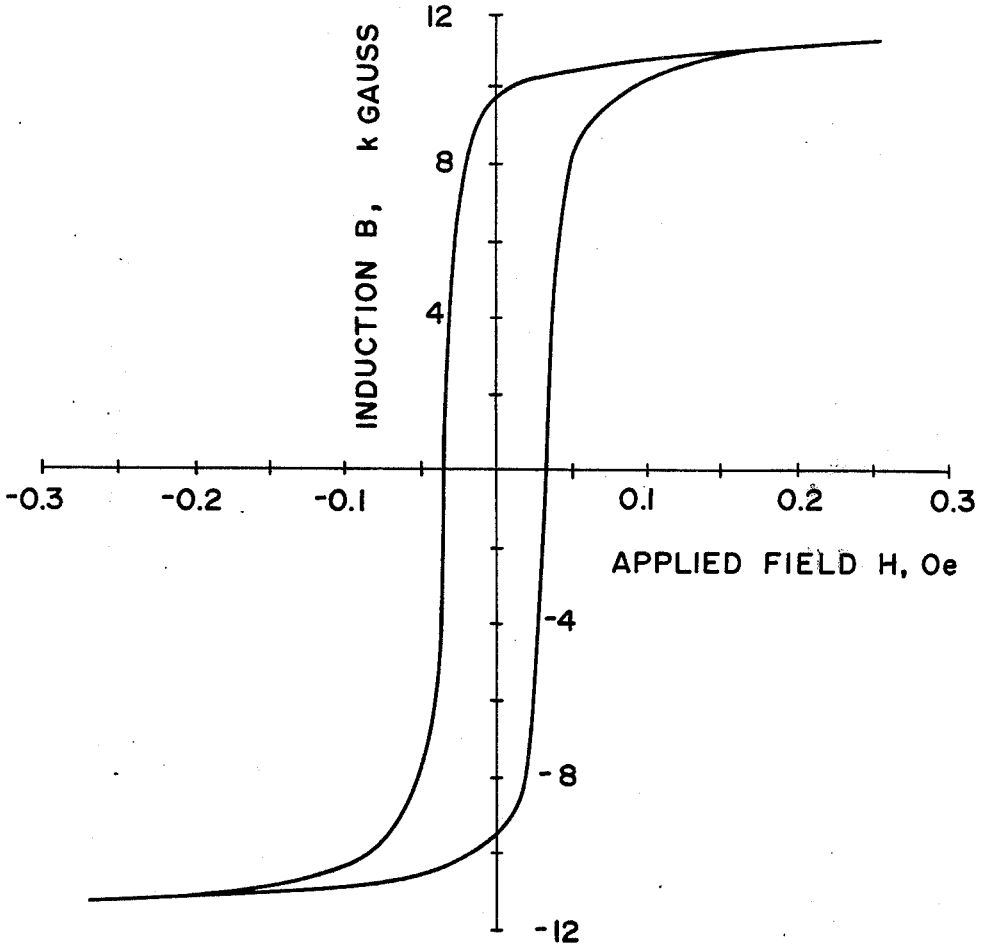
FIG. 1, on coordinates of induction in kGauss and applied field in Oe, is a plot of the hysteresis curve of a glassy metal alloy of the invention having the composition $Co_{74}Fe_6B_{20}$.

The dc hysteresis loop for an as-wound/as-quenched toroid of one of these metallic glasses ($Co_{74}Fe_6B_{20}$) is shown in FIG. 1. The high saturation induction of this alloy relative to previously known glassy metal alloys results from the use of boron as the principal or only metalloid, and carbon as the secondary metalloid. In general, the glassy metal alloys of the invention have considerably higher saturation inductions and Curie temperatures ($T_C$) than other glassy metal alloys of the same transition metal content but containing primarily metalloids other than boron and carbon. Without subscribing to any particular theory, these unexpected, improved properties are obtained due to the presence of boron and carbon, which transfer less charge to the transistion metal d-bands than the other metalloid elements.

Figure 2:
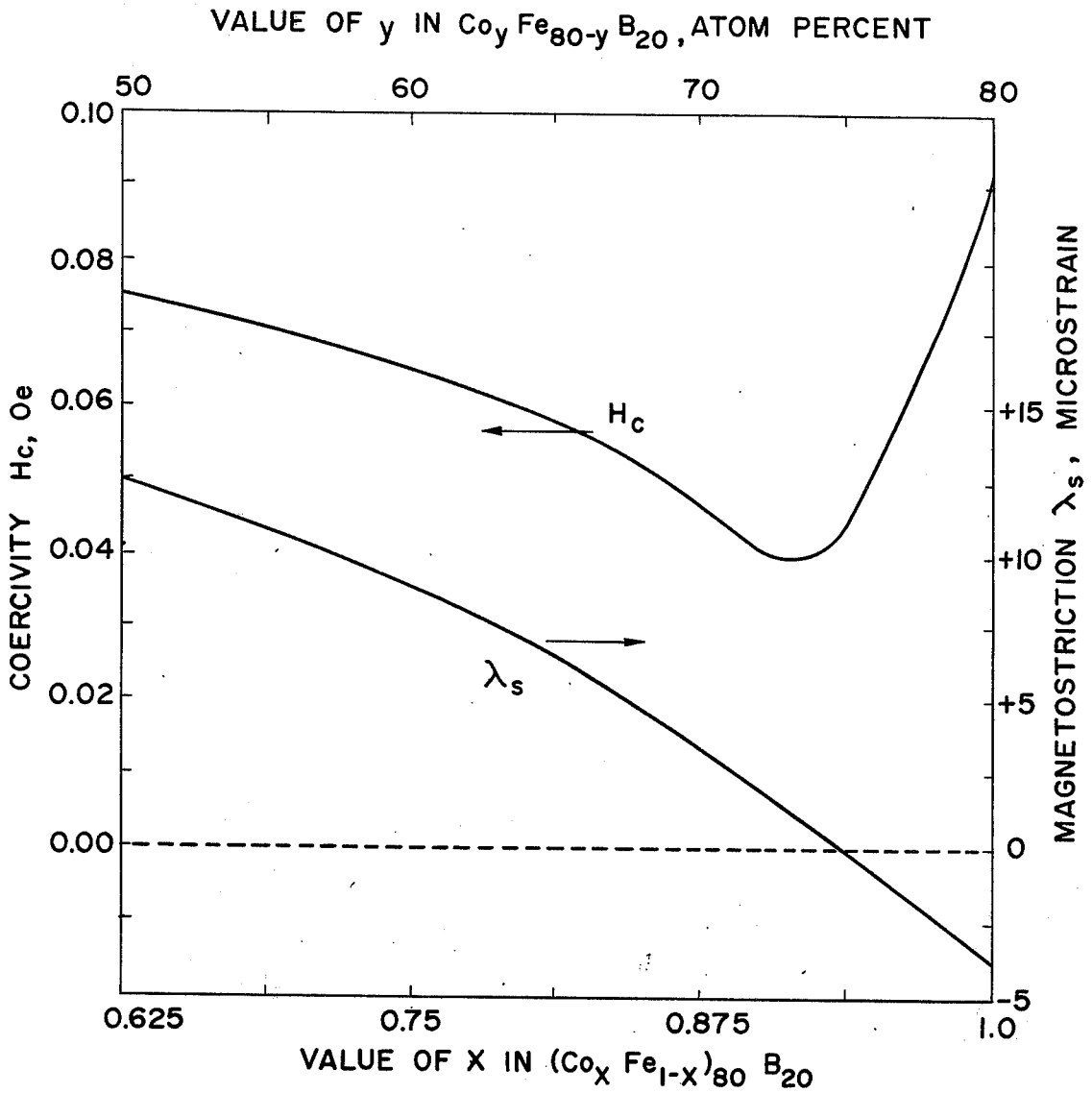
FIG. 2, on coordinates of (a) coercivity in Oe and (b) magnetostriction in microstrains and composition in atom percent, is a plot of the dependence of the coercivity and magnetostriction on the value of $x$ of a glassy alloy of the invention having the composition $(Co_xFe_{1-x})_{80}B_{20}$.

FIG. 2 shows the variation of the saturation magnetostriction $\lambda_s$ and coercivity $H_c$ for the glassy metal alloy $(Co_xFe_{1-x})_{80}B_{20}$ over the range of $x$ from 0.625 to 1.0 (or, equivalently, for the glassy metal alloy $Co_yFe_{80-y}B_{20}$ over the range of $y$ from 50 to 80 atom percent). Because of the absence of magnetocrystalline anisotropy in these glassy metal alloys, the compositional dependence of $H_c$ follows closely that of the absolute value of saturation magnetostriction $\lambda_s$.

For some applications, it may be desirable or acceptable to use a material with a small positive or a small negative magnetostriction. For example, a low magnetostriction alloy of greater flux density or higher $T_C$ (smaller $\delta M/\delta T$) than is available for an alloy of zero magnetostriction may be desirable. Such near-zero magnetostrictive glassy metal alloys are obtained for $x$ in the range of about 0.84 to 1.0. The absolute value of saturation magnetostriction $|\lambda_s|$ of these glassy metal alloys is less than about $5 \times 10^{-6}$ (i.e., the saturation magnetostriction ranges from about $+5 \times 10^{-6}$ to $-5 \times 10^{-6}$, or $+5$ to $-5$ microstrains). The saturation induction of these glassy alloys is at least about 10 kGauss.

Values of $\lambda_s$ even closer to zero may be obtained for values of $x$ ranging from about 0.91 to 0.98. For such preferred compositions, $|\lambda_s|$ is less than $2 \times 10^{-6}$. Essentially zero values of magnetostriction are obtained for values of $x$ ranging from about 0.92 to 0.96, and, accordingly, such compositions are most preferred.

The glassy metal alloys of the invention are conveniently prepared by techniques readily available elsewhere; see, e.g., U.S. Pat. Nos. 3,845,805, issued Nov. 5, 1974 and 3,856,513, issued Dec. 24, 1974. In general, the glassy alloys, in the form of continuous ribbon, wire, etc., are rapidly quenched from a melt of the desired composition at a rate of at least about $10^5$ °K/sec.

A metalloid content of boron, and, optionally, carbon, in the range of about 15 to 22 atom percent of the total alloy composition is sufficient for glass formation, with boron ranging from about 10 to 22 atom percent and carbon ranging from about 0 to about 12 atom percent and with increased carbon content generally associated with increased total metalloid content.

The ease of glass formation is increased by employing carbon in the range of 0 to about 4 atom percent, together with a total metalloid content of about 17 to 20 atom percent. Accordingly, such compositions are preferred.

It was mentioned above that boron and carbon containing glassy metal alloys have the highest saturation inductions and Cuie temperatures, compared with other metalloid elements. However, the effect of the metalloids on the magnetostriction is slight for these glassy metal alloys of the invention. Zero magnetosriction is realized for a Co:Fe ratio of approximately 11.5:1 in the crystalline alloys ($Co_{92}Fe_8$) as well as in glassy metal alloys of the invention, such as $Co_{73.6}Fe_{6.4}B_{20}$ and $Co_{73.6}Fe_{6.4}B_{14}C_6$. In the prior art glassy metal alloys containing the metalloids of silicon, phosphorus, aluminum and boron, the Co:Fe ratio for $\lambda_2 = 0$ increases somewhat to 14:1, as represented in the composition $Co_{70}Fe_5M_{25}$. It is not clear whether this change is due to the lower transition metal/metalloid ratio in these glasses or to the presence of the other metalloids. It is clear, however, that this shift in the zero-magnetostriction composition is not as significant as the metalloid effects on the saturation induction and the Curie temperature.

Table III provides a comparison of relevant magnetic properties of zero magnetostrictive alloys of the invention with alloys of the prior art. Approximate values or ranges are given for saturation induction $B_s$, magnetocrystalline anisotropy K and coercivity $H_c$ of several alloys of zero magnetostriction, including the new glassy metal alloys disclosed herein. Low coercivity is obtained only when both $\lambda_s$ and K approach zero. The large negative anisotropy of the crystalline Co—Fe alloy is a drawback in this regard. This large anisotropy may be overcome by making a glassy metal composition of approximately the same Co:Fe ratio as the crystalline alloys shown in Table III. Zero magnetrostriction is still retained. However, the presence of the metalloids P, Si and Al dilute and degrade the ferromagnetic state to the extent that the available flux density is low. The glassy metal alloys of the invention, in contrast, possess zero and near-zero magnetostriction with significantly improved flux density relative to the 80% nickel alloys. It is expected that the development of proper annealing procedures will further improve the coercivity and permeability.

TABLE III

| Alloy Composition (Atom Percent) | $B_s$ (kGauss) | K ($10^3$ erg/cm$^3$) | $H_c$ (Oe) |
|---|---|---|---|
| Prior Art Crystalline | | | |
| 78-80% Ni* | 6 to 8 | −1 | 0.01 |
| 88-94% Co* | 19 | $-10^3$ | — |
| 9% Si, 6% Al* (wt. %) | 11 | 0 | 0.05 |
| Prior Art Glassy | | | |
| $Co_{72}Fe_3P_{16}B_6Al_3$ | 7 | +1 | 0.013 |
| $Co_{71}Fe_4Si_{15}B_{10}$ | 6 | +1 | 0.013 |
| This Invention, Glassy | | | |
| $Co_{74}Fe_6B_{20}$ | 11.8 | +1 | 0.03 |
| $Co_{74}Fe_6B_{14}C_6$ | 11.8 | +1 | 0.04 |
| $Co_{74}Fe_6B_{16}C_4$ | 11.8 | +1 | 0.03 |

*balance Fe

EXAMPLES

1. Sample Preparation

The glassy alloys were rapidly quenched (about $10^6$°K/sec) from the melt following the techniques taught by Chen and Polk in U.S. Pat. No. 3,856,513. The resulting ribbons, typically 50 $\mu$m × 1 mm in cross-section, were determined to be free of significant crystallinity by X-ray diffractometry (using $CuK_\alpha$ radiation) and scanning calorimetry. Ribbons of the glassy metal alloys were strong, shiny, hard and ductile.

2. Magnetic measurements

Continuous ribbons of the glassy metal alloys 6 to 10 m in length were wound onto bobbins (3.8 cm O.D.) to form closed-magnetic-path toroidal samples. Each sample contained form 1 to 3 g of ribbon. Insulated primary and secondary windings (numbering at least 100 each) were applied to the toroids. These samples were used to obtain hysteresis loops (coercivity and remanence) and initial permeability with a commercial curve tracer and core loss (IEEE Standard 106-1972).

The saturation induction, $B_s = H + 4\ \pi M_s$, was measured with a commercial vibrating sample magnetometer (Princeton Applied Research). In this case, the ribbon was cut into several small sqaures (approximately 1 mm × 1 mm). These were randomly oriented about their normal direction, their plane being parallel to the applied field (0 to 9 kOe). The saturation induction increased linearly as a function of increasing iron content from 11.4 kGauss for $Co_{80}B_{20}$ to 12.3 kGauss for $Co_{70}Fe_{10}B_{20}$.

Magnetization versus temperature was measured from 4.2° to 1000° K in an applied field of 8 kOe in order to obtain the saturation moment per metal atom $n_B$ and Curioe temperature, $T_C$. The saturation moment increased linearly as a function of increasing iron content from 1.3 Bohr magnetons per metal atom for $Co_{80}B_{20}$ to 1.4 Bohr magnetons per metal atom for $Co_{70}Fe_{10}B_{20}$. In all cases, $T_C$ was well above the crystallization temperature of the glassy metal alloys, which ranged from 623° to 693° C. Therefore, $T_C$ was estimated by extrapolation of M(T) for the glassy phase. The extrapolated Curie temperature of $Co_{80}B_{20}$ fell in the range 750° to 800° K, and the addition of iron increased $T_C$ still further.

Magnetostriction meausrements employed semiconductor strain gauges (BLH Electronics), which were bonded (Eastman - 910 Cement) between two short lengths of ribbon. The ribbon axis and gauge axis were parallel. The magnetostriction was determined as a function of applied field from the longtiudinal strain in the parallel ($\Delta_{\parallel}$)and perpendicular ($\Delta_{\perp}$) in-plane fields according to the formula $\lambda = \frac{2}{3}(\Delta_{\parallel} - \Delta_{\perp})$.

What is claim is:

1. A magnetic alloy that is at least 50% glassy, having the formula $(Co_xFe_{1-x})_aB_bC_c$, where B is boron and C is carbon and where $x$ ranges from about 0.92 to 0.96, $a$ ranges from about 78 to 85 atom percent, $b$ ranges from about 10 to 22 atom percent and $c$ ranges from 0 to about 12 atom percent, with the proviso that the sum of $b$ and $c$ ranges from about 15 to 22 atom percent, said alloy having a value of magnetostriction of essentially zero.

2. The magnetic alloy of claim 1 in which $c$ ranges from 0 to about 4 atom percent and the sum of $b$ and $c$ ranges from about 17 to 20 atom percent.

3. The magnetic alloy of claim 1 having the formula $Co_{74}Fe_6B_{20}$.

4. The magnetic alloy of claim 1 having the formula $Co_{74}Fe_6B_{14}C_6$.

5. The magnetic alloy of claim 1 having the formula $Co_{74}Fe_6B_{16}C_4$.

* * * * *